US007905290B2

(12) United States Patent
Schicks

(10) Patent No.: US 7,905,290 B2
(45) Date of Patent: Mar. 15, 2011

(54) DEVICE FOR THE THERMAL STIMULATION OF GAS HYDRATE FORMATIONS

(76) Inventor: Judith Maria Schicks, Potsdam (DE)

( * ) Notice: Subject to any disclaimer, the term of this patent is extended or adjusted under 35 U.S.C. 154(b) by 0 days.

(21) Appl. No.: 12/559,894

(22) Filed: Sep. 15, 2009

(65) Prior Publication Data

US 2010/0006287 A1 Jan. 14, 2010

Related U.S. Application Data

(62) Division of application No. 11/243,605, filed on Oct. 5, 2005, now abandoned.

(51) Int. Cl.
*E21B 36/00* (2006.01)
*E21B 43/24* (2006.01)

(52) U.S. Cl. ..... 166/302; 166/58; 166/272.1

(58) Field of Classification Search ..... None
See application file for complete search history.

(56) References Cited

U.S. PATENT DOCUMENTS

| | | | |
|---|---|---|---|
| 2,324,172 | A | 7/1943 | Parkhurst |
| 6,148,911 | A | 11/2000 | Gipson et al. |
| 6,228,146 | B1 | 5/2001 | Kuespert |
| 6,973,968 | B2 | 12/2005 | Pfefferle |
| 2004/0060438 | A1 | 4/2004 | Lyon |

FOREIGN PATENT DOCUMENTS

| | | | |
|---|---|---|---|
| DE | 19849337 | A1 | 1/2000 |
| JP | 09158662 | A | 6/1997 |
| RU | 2169834 | | 6/2001 |
| WO | WO99/19283 | A1 | 4/1999 |
| WO | WO00/47832 | A1 | 8/2000 |

OTHER PUBLICATIONS

Schicks et al., "Nanoengineered catalysts for high-temperature methane partial oxidation", *Catalysts Today* 81:287-296 (2003).
Schicks et al., "Novel nano-disperse catalysts for direct oxication of methane to synthesis gasL", Paper No. 348a, AIChE Annual Meeting (2001).
Veser et al., "Syngas formation by direct oxidation of methane reaction mechanisms and new reactor concepts", *Catalysts Today* 61:55-64 (2000).
Friedle et al., "A counter-current heat-exchange reactor for high temperature partial oxidation reactions", *Chemical engineering Science* 54:1325-1332 (1999).
Friedle et al., "Synthesis gas by direct oxidation of methane in a catalytic heat-exchange reactor", D. Hanicke (Ed.), *Synthesis Gas Chemistry* DGKM, Hamburg (2000).
Melygunov et al., Method of recovering natural gas from gas hydrates (Jan. 2009) English translation of previously cited RU 2169834.

*Primary Examiner* — Zakiya W. Bates
(74) *Attorney, Agent, or Firm* — Drinker Biddle & Reath LLP

(57) ABSTRACT

A method for the thermal stimulation of a geological gas hydrate formation (10) is described in which thermal energy is supplied to the gas hydrate formation (10) so that gas hydrates in the gas hydrate formation (10) are converted and gaseous components are released and the supplied thermal energy is delivered by an exothermal chemical reaction that takes place in a reactor (20) arranged in the gas hydrate formation (10). A device for carrying out the process is also described.

19 Claims, 3 Drawing Sheets

20: $2CH_4 + O_2 \rightarrow 4H_2 + 2CO$

50: $2CO + O_2 \rightarrow 2CO_2$

20: $2CH_4 + O_2 \rightarrow 4H_2 + 2CO$

20: $2CH_4 + O_2 \rightarrow 4H_2 + 2CO$

50: $2CO + O_2 \rightarrow 2CO_2$

DEVICE FOR THE THERMAL STIMULATION OF GAS HYDRATE FORMATIONS

The present application is a divisional of U.S. Application No. 11/243,605 filed Oct. 5, 2005, which claims priority under 35 U.S.C. 119(a) to German Patent Application Number DE102004048692.1, filed on Oct. 6, 2004, the contents of which are hereby incorporated by reference in their entirety.

FIELD OF THE INVENTION

The present invention is related to a process for the thermal stimulation of gas hydrate formations in which gas hydrates are converted under the action of thermal energy, to a device for carrying out the process and to applications of the process.

BACKGROUND OF THE INVENTION

Gas hydrate formations (clathrate formations) are terrestrial or marine formations containing gas hydrates. Gas hydrates are solids formed from gases (e.g., methane) and water under certain conditions of pressure and temperature. At low temperatures and high pressures the gases are enclosed in clathrate cages formed by water molecules. These conditions occur, e.g., in marine sediments in the ocean and in sediments of permafrost regions. There is an interest for several reasons in releasing the gases from gas hydrate formations. On the one hand, a large part of the world's hydrocarbon reserves are assumed to be bound in the form of gas hydrates in the sediments. Their release would open up a significant source of raw material. On the other hand, gas hydrate formations overlie large deposits of natural gas, e.g., in Siberia. An extraction of gas hydrates would facilitate the extraction of natural gas.

It is known that gaseous components can be released from gas hydrate formations by local elevations of temperature. A temperature elevation disturbs the equilibrium state of the hydrates in such a manner that the three-dimensional network of water cages releases the gases and the sediment remains with the water as a spongy matrix. Attempts to elevate the temperature by introducing water vapor or hot water in bores in sediments with gas hydrates are known (see, e.g., WO 99/19283, JP 09158662). However, these processes have proven to be ineffective and energy-intensive. Sediment layers with gas hydrates have a low permeability, so that the introduction of hot media is only possible with a high expenditure of energy.

Furthermore, US 2004/0060438 and DE 198 49 337 teach disturbing the thermodynamic equilibrium in gas hydrate formations by introducing liquid carbon dioxide or methanol and releasing gaseous components from the gas hydrate as a consequence thereof. However, this chemical treatment of gas hydrates is limited to local effects in the vicinity of a borehole and is furthermore characterized by an unfavorable energy balance. In addition, laboratory experiments show that an exchange of hydrate-bound methane with $CO_2$ takes place only proportionately and therefore the complete methane gas cannot be extracted from the hydrates. The same applies to the extraction of methane hydrate with compressed air that is described, e.g., in WO 00/47832.

U.S. Pat. No. 6,148,911 teaches effecting the desired elevation of temperature by electrical heating. This technology has several disadvantages. In the first place, the course of the process is technically very complicated and energetically ineffective. Another disadvantage consists in a limitation to a narrow extraction plane on which a heating procedure can be carried out. Thus, a systematic extraction of gas hydrates in a geological formation is only possible with a high expenditure of time and energy.

Furthermore, the conventional release of gases from gas hydrate formations is associated with the following problems. The utilization of gas hydrates as a raw material source can be critical if the greenhouse gas $CH_4$ is inadvertently released in large amounts during the extraction or if $CO_2$ is released during the combustion of methane. Moreover, there can be a danger of a destabilization of geological formations resulting in significant risks to the environment, particularly in the case of the extraction of gas hydrates on continental shelves.

Studies for designing catalytic materials for a partial oxidation of methane are known (see, e.g., J. Schicks et al. in "Catalysis Today", vol. 81, 2003, pp. 287-296; J. Schicks et al. in paper No. 348*a*, AICheE Annual Meeting, 2001, Reno, Nev.; G. Veser et al. in "Catalysis Today", vol. 61, 2000, pp. 55-64; U. Friedle et al. in "Chemical Engineering Science", vol. 54, 1999, pp. 1325-1352; U. Friedle et al. in D. Hänicke (editor), "Synthesis Gas Chemistry", DGKM, Hamburg, 2000, p. 53 ff.). These studies were laboratory experiments with short reaction times.

OBJECT OF THE INVENTION

The object of the invention is to indicate an improved process for the thermal stimulation of a gas hydrate formation with which the disadvantages of the conventional technologies are overcome. The novel process should in particular be able to be implemented with low technical expense and high energy efficiency and to make possible a systematic extraction of gas within practicable time periods and, if necessary, while avoiding damage to the environment. Another object of the invention is to indicate a device for implementation and applications of the process.

SUMMARY OF THE INVENTION

These objects are solved by a process and a device with the features in accordance with Claims 1 and 14. Advantageous embodiments and applications of the invention result from the dependent claims.

As concerns the process, the invention is based on providing a process for the thermal release of at least one gaseous component from geological gas hydrates in which the energy required for disturbing the thermodynamic equilibrium of gas hydrates and therewith for releasing gas is supplied by the reaction heat of a chemical reaction that takes place in the geological gas hydrate, that is, in a terrestrial or marine gas hydrate formation. The gas hydrate formation contains at least one sediment layer conducting gas hydrates, in which layer a reactor is positioned, in which an exothermal chemical reaction takes place. The reaction heat of this reaction is conducted via the direct thermal conduction contact of the reactor with the environment directly into the sediment layer with gas hydrates in order to disturb at that location the pressure-temperature equilibrium and thus achieve their decomposition.

It could be established with the invention that a stable chemical reaction can be surprisingly started under the inaccessible conditions in a borehole that supplies sufficient thermal energy for obtaining the reaction and also for decomposing gas hydrates. Furthermore, the process according to the invention has the advantage that the site of the local heating of the gas hydrate formation can be freely selected by the positioning of the at least one reactor, e.g., with available boring technology, and that the energy released during the exothermal chemical reaction can be used directly and completely for thermally stimulating the gas hydrates. The energy balance of the process according to the invention is therefore significantly improved in comparison to conventional processes since the reaction heat can be used without loss and without intermediate steps.

If, according to a preferred embodiment of the invention, at least one of the reaction partners is supplied to the reactor from a reservoir outside of the sediment layer conducting the gas hydrate, particularly from the surface of the earth, this can yield advantages for the ability to control the exothermal chemical reaction. The amount of the reaction partner supplied from the outside into the gas hydrate formation can be adjusted, e.g., by a dosing of gas of by an introduction under elevated pressure, particularly for influencing the chemical equilibrium or the yield of the reaction in a predetermined manner. It is particularly advantageous if a gaseous reaction partner containing oxygen is supplied from the outside into the reaction since the oxygen-containing reaction partner is readily available, e.g., as pure oxygen or as air under practical conditions at the boring site for the extraction of gas hydrate.

According to another preferred embodiment of the invention at least one of the reaction partners of the exothermal chemical reaction is obtained from the surrounding of the reactor. The supplying of the reaction partner from the gas hydrate formation has the advantage that the desired chemical reaction is fed directly from the energy-rich gas hydrates. Furthermore, complications during the preparation of the reaction can be avoided by a separate supplying of reaction partners on the one hand from outside and on the other hand from the gas hydrate formation. The use of at least one hydrocarbon compound (as a rule methane) contained in the gas hydrates as reaction partner is particularly preferred since numerous reaction paths with a high yield of reaction heat are known for this group of substances.

It is particularly preferable that the exothermal chemical reaction comprises a partial oxidation of methane. This reaction has the advantage that the geological gas hydrate formations have a high methane content. The methane gas being released during the thermal decomposition of gas hydrates is converted by the partial oxidation into synthesis gas that advantageously can be removed from the reactor to the outside, particularly to the surface of the earth, for further use in particular for further reactions such as, e.g., the synthesis of methanol or the fractionation into CO and $H_2$. The equilibrium of the partial oxidation of methane to synthesis gas is advantageously completely on the right side of the following reaction equation so that a substantially complete conversion of methane is possible:

$$2\ CH_4+O_2 \rightarrow 2\ CO+4\ H_2.$$

In this reaction that takes place exothermally the oxygen is introduced, e.g., as atmospheric oxygen through a bore arrangement from the atmosphere into the reactor.

If the reaction partner supplied from the gas hydrate formation is collected via at least one gas inlet membrane hose, further advantages for a high yield of the exothermal reaction can be obtained. Preferably, the gas supplied from the surrounding gas hydrate is subjected to a step of drying by a drying agent arranged in the at least one gas inlet membrane hose. Accordingly, the water content of the reaction partner can be reduced and the exothermal reaction in the reactor can be further improved.

According to a preferred variant of the invention the gaseous components of the gas hydrate formation are removed after their release from the geological layer and exothermal conversion to the surface of the earth for further usage. This advances the further exothermal reaction in the reactor in an advantageous manner and makes the released gas available, e.g., for the further obtaining of energy. For example, the synthesis gas extracted by the direct partial oxidation of methane is separated after being transported to the surface by a current process (e.g., partial condensation process). The hydrogen can be used for operating fuel cells.

The energy yield can be advantageously increased even more if released gases such as, e.g., carbon monoxide are reconverted exothermally. According to another embodiment of the invention it is therefore provided that at least one component of the released gas is supplied to an exothermal subsequent reaction in the gas hydrate formation. As a result, the further conversion can be used in the gas hydrate formation to disturb the thermodynamic equilibrium of the solid gas hydrates, thus increasing the effectiveness of the process of the invention. If, e.g., synthesis gas is formed in accordance with the above-indicated example during the partial oxidation of methane, a return of the separated carbon monoxide into the same or an additional reactor follows that is also located in the borehole. This return into the additional reactor takes place with a simultaneous supplying of an oxygen-containing reaction partner, particularly oxygen or air. The carbon monoxide is oxidized up to carbon dioxide in the additional reactor and the energy released can also be directly used to decompose the surrounding gas hydrates. In order to achieve the broadest possible action the hottest part of the additional reactor should be located at a different height than that of the reactor for methane oxidation.

A particular advantage of the return in accordance with the invention of the released gas to an exothermal subsequent reaction is that they are applied in a well-dosed manner, particularly under the following conditions. For example, an additional supply of energy can be desired if the partial oxidation reaction is still running too hesitantly for releasing methane in greater amounts. Secondly, it is possible that the gas hydrates are already decomposed in the direct reactor environment.

If carbon monoxide is produced in the process according to the invention as one of the reaction products, as an alternative to generating more reaction heat in the gas hydrate it can also be used to gain energy for other purposes on the surface. By the further oxidation of carbon monoxide as end product, carbon dioxide is formed, the presence of which as a greenhouse gas is undesired in the atmosphere. The invention provides the following further processing of carbon dioxide. A collection of the carbon dioxide takes place in a container in the gaseous or liquid state. When the gaseous components from a sediment layer with gas hydrates have been degraded and have cooled off, the collected carbon dioxide is introduced under pressure into the sediment layer. The water is still contained in the sediment layer from the previous gas hydrate state so that $CO_2$ hydrates can form that can be deposited in the sediment for a long time in a stable manner on account of the higher stability compared, e.g., to methane hydrates, under the given conditions of pressure and temperature. Advantageously, not only the carbon dioxide is removed by this process, but at the same time a stabilization of the sediments with a gas hydrate is achieved so that the above-mentioned dangers for the environment are reduced.

The generation of $CO_2$ hydrates and geological sentiments described here by the introduction of carbon dioxide under pressure can be used not only for the carbon dioxide obtained from the synthesis gas by oxidation but also with carbon dioxide from any other source.

If, according to another particularly preferred embodiment of the invention, the exothermal chemical reaction takes place in the presence of the catalyst in the reactor, other advantages result for the yield and energy balance of the reaction. In particular, in the cited example of the partial oxidation of methane the use of a catalyst produces an autothermal course of reaction. According to a preferred variant of the invention a conditioning of the catalyst is performed as start reaction for adjusting defined reaction conditions in order to bring the catalyst to the desired start temperature of the exothermal chemical reaction, particularly by heating.

If an oxidation of a hydrogen containing gas, e.g., air-hydrogen mixture, takes place for the conditioning, advantages result from the easy ignitability and the strongly exothermal combustion of the hydrogen to water, so that the desired start temperature is rapidly achieved and a heating of the catalyst by an external heating is superfluous.

Another important advantage of the invention is that the gas hydrate heating can be carried out by reaction heat with the available technology for access to natural gas hydrate formations. The reactor can be arranged with a piping arrangement in a borehole, particularly in a borehole in the gas hydrate formation at the desired depth of a sediment layer with gas hydrates.

Further advantages in terms of an effective exploration of a gas hydrate formation are obtained, if the reactor is shifted in the gas hydrate formation for heating changing regions in the gas hydrate formation. If a condition of complete decomposition has been obtained in the gas hydrate formation, the reactor is displaced to another position for further decomposition. Advantageously, this displacement can be obtained with available piping technology by changing the depth of the reactor in the gas hydrate formation.

As concerns the apparatus, the invention is based on the general technical teaching of providing a device for the thermal stimulation or treatment of a geological gas hydrate formation that comprises at least one piping arrangement for establishing a connection between the gas hydrate formation and the free surface of the earth and comprises a heating device for heating the gas hydrates and for the release of gaseous components, which heating device comprises a reaction chamber in the piping arrangement that is designed for receiving reaction partners of an exothermal chemical reaction and is in thermal contact with the environment of the piping arrangement, in particular with the surrounding gas hydrate formation.

A reactor, particularly with the reaction chamber, is a part of the piping arrangement, e.g., a certain axial section of the piping arrangement, or a component arranged in the piping arrangement at the desired depth. In distinction to the conventional technologies in which media heated at great cost and loss of energy are introduced into a borehole and pressed into the gas hydrate or in which electrical lines must be run through the borehole for forming a resistance heating, the device in accordance with the invention represents a compact system that is compatible without great expense with conventional boring technologies and that advantageously localizes the energy conversion of the thermal decomposition energy for the gas hydrates in the gas hydrate formation.

If the reactor comprises a tube reactor with a cylindrical form whose reaction zone is formed on the outer circumferential edge of the piping arrangement, advantages can result on the one hand for an effective supply of reaction partners inside the piping arrangement and on the other hand for an optimal thermal transfer to the environment, that is, into the gas hydrate formation.

According to another preferred embodiment of the invention the reactor contains a catalyst with which the substance and energy yield of the desired exothermal reaction in the gas hydrate formation can be advantageously optimized. The catalyst preferably contains a noble metal such as, e.g., platinum or rhodium for the exothermal conversion of hydrocarbons contained with precedence in gas hydrates. A possible structure is given with a monolith consisting, e.g., of aluminum oxide (foam monolith or extruded monolith) that is coated with platinum or some other noble metal. The provision of the monolith is particularly preferred with embodiments of the invention having high gas flow rate. Such monoliths are advantageously available in very different forms so that they can be used in a suitable manner for the reactor. Another variant is catalysts with a catalytic carrier material of barium hexaaluminates in which platinum or other noble-metal particles are embedded. This embodiment of the invention has the advantage over the coated monoliths cited that less noble metal is required at the same efficiency and stability.

The heat transfer from the reactor to the surrounding gas hydrate formation is further improved, if the catalyst is arranged on an inner surface of an outer reactor wall. Accordingly, the catalyst is preferably coated on the inner surface.

According to another variant of the invention the heating device for carrying out an exothermal subsequent reaction comprises an additional reactor that is also provided in the piping arrangement. The additional reactor is used, e.g., for the further oxidation of carbon monoxide to carbon dioxide. Another heat source for the thermal stimulation of gas hydrates is advantageously formed in the piping arrangement by the availability of the additional reactor. In order to increase the efficiency of the conversion of energy and/or substances in the subsequent reaction the additional reactor can contain a catalyst in accordance with a preferred structure.

The device according to the invention makes it possible by controlling the boring or the predetermined positioning of the reactor in the piping arrangement that the position of the heat source in the sediment layer can be optimized. According to the invention several reaction chambers, that is, several reactors and/or additional reactors for the subsequent reactions can be provided in a piping arrangement that are arranged adjacent to each other but preferably axially separated from each other. It is particularly advantageous in this instance that gas hydrates at different depths or particularly thick gas hydrate formations can be thermally stimulated with one borehole.

According to another modification the device according to the invention is equipped with a pressure apparatus with which, as described above, gaseous components or resultant products such as, e.g., carbon dioxide formed from them can be returned into the gas hydrate formation. The pressure apparatus comprises, e.g., a high-pressure pump.

According to a further advantageous embodiment of the invention, the reactor is provided with at least one gas inlet membrane hose for collecting the reaction partner from the surrounding geological formation into the reactor. Preferably, the at least one gas inlet membrane hose contains a drying agent, like e.g. silica gel or another substance with a comparable water binding property. The provision of the drying agent in the hose has advantages in terms of stabilizing the hose against outer pressure and reducing the water contents in the gas supplied to the reactor.

An independent subject matter of the invention is constituted by a hydrate extraction system comprising at least one device for the thermal stimulation of gas hydrates with the described features. The hydrate extraction system is furthermore equipped with operating devices for positioning the piping arrangement, for the supply or removal of reaction partners or reaction products, for collecting reaction products or resultant products and for controlling the device.

Another independent subject matter of the invention is constituted by the use of the process, of the device or of the hydrate extraction system in accordance with the invention for the extraction of gas for an underground or submarine gas hydrate formation, in particular for the extraction of raw materials or the conversion of energy or for the controlled extraction of gases from a gas hydrate formation.

BRIEF DESCRIPTION OF THE DRAWINGS

Further details and advantages of the invention are described in the following with reference made to the attached drawings.

DETAILED DESCRIPTION OF THE INVENTION

Figure 1:
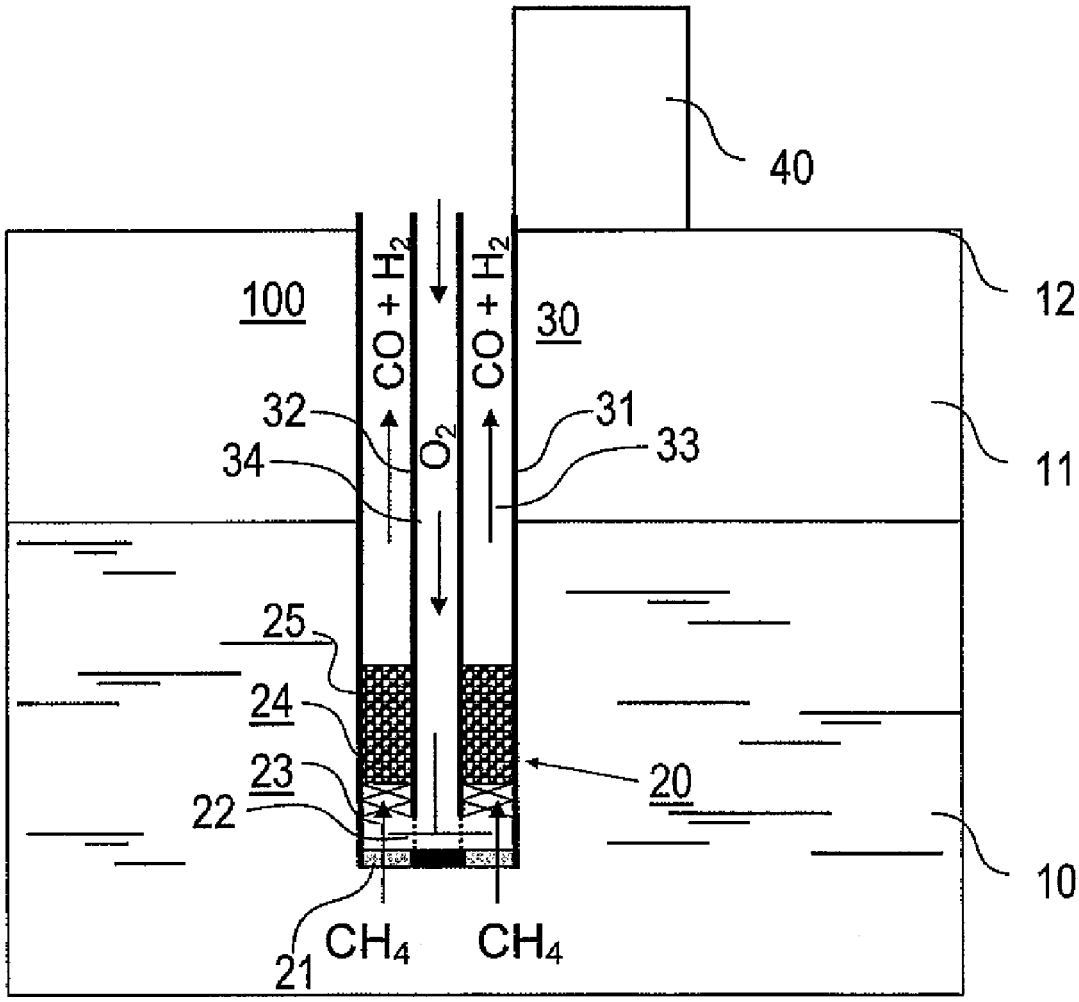
FIG. 1: shows a schematic longitudinal section of a first embodiment of the invention with a single tube reactor.

The invention is described by way of example in the following with reference made to its use in a borehole. However, the implementation of the invention is not limited to the embodiment explained but is also possible in other geological applications permitting access to gas hydrate formations. Moreover, it is stressed that the attached drawings schematically illustrate the features of the embodiments shown. In the concrete implementation of the invention into practice the concrete dimensional conditions and forms, particularly of the reaction chambers and of the other components can be selected as a function of the use. The device in accordance with the invention is preferably arranged in a known bore pipe that is not shown in the drawings. Details of the borehole and of the boring technology, which are also known, are not described in the following.

The device 100 according to the invention for the thermal stimulation of gas hydrates is introduced in accordance with FIG. 1 through the upper earth layers into the gas hydrate formation 10. The heating device of device 100 is a tube reactor 20 on the lower free end of the piping arrangement 30. The gas hydrate formation 10 comprises, depending on the geological conditions, a substantially homogeneous sediment layer with gas hydrates or a series of sediment layers with gas hydrates that are separated by layers free of hydrates. The gas hydrate formation 10 is separated from surface of the earth 12 (or appropriately, from the ocean surface) by a hydrate-free sediment layer 11 (not shown true to scale) and, if applicable, by the ocean.

The piping arrangement 30 comprises a single coaxial arrangement with an outer pipe 31 and an inner pipe 32. The pipes 31, 32 are coaxially positioned. The outer pipe 31 forms a protective jacket for the device 100 and a discharge line 33 for the reaction products of the exothermal reaction taking place in reactor 20. The inner pipe 32 forms an inlet line 34 for one of the reaction partners of the reaction taking place in reactor 20. The pipes 31, 32 consist, e.g., of high-grade steel. Their dimensions are selected as a function of the concrete conditions of use.

The piping arrangement 30 also serves for the positioning of the reactor in the borehole or in the bore pipe. Alternatively, other devices such as, e.g., a cable or a rod can be provided for positioning the reactor, in which case the supply and removal lines for the reaction partners or reaction products are run separately.

Figure 4:
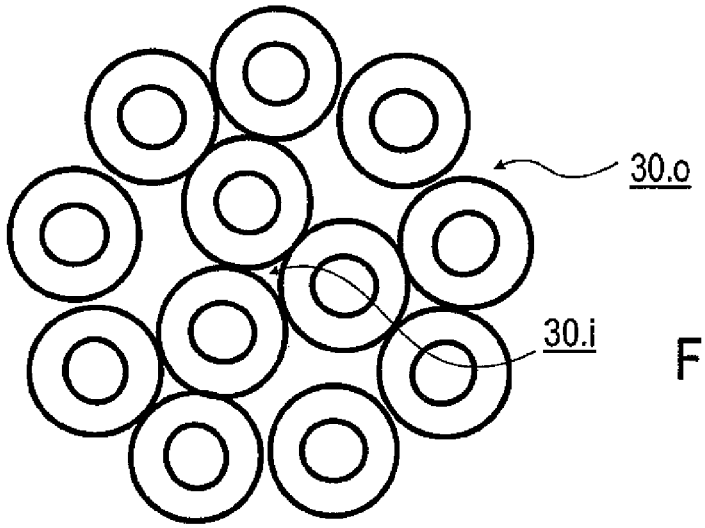
FIG. 4: shows a schematic cross sectional representation of another embodiment with several tube reactors.
Figure 5:
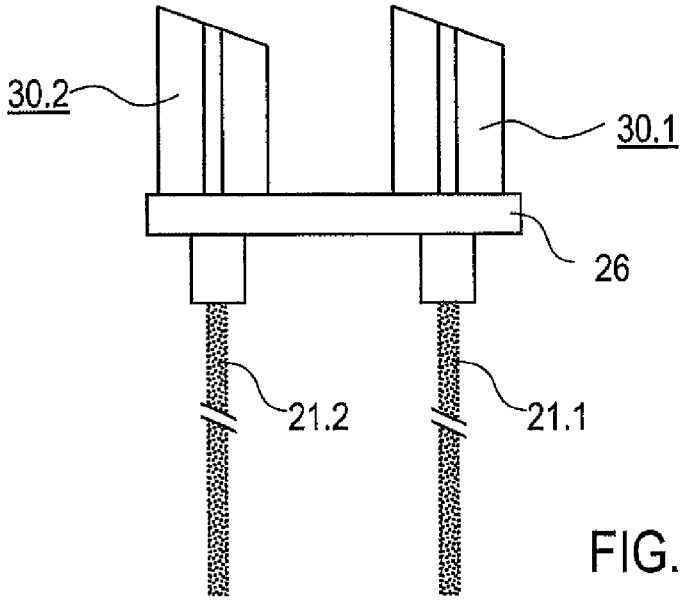
FIG. 5: shows a schematic longitudinal section of another embodiment of the invention with gas inlet membrane hoses (partial view).

The reactor 20 is a tube reactor that is arranged in the interval between the inner pipe 32 and the outer pipe 31 and that comprises, starting from the free end of the piping arrangement 30, at first a first gas inlet 21 for supplying the first reaction partner from gas hydrate formation 10 and a second gas inlet 22 for supplying the second reaction partner from the inner tube 32. A gas-permeable but water-impermeable covering such as, e.g., a partially permeable membrane or a body with a large inner surface (e.g., of PTFE) that forms a closure of the piping arrangement relative to the gas hydrate environment is located in the first gas inlet 21. The membrane located in the first gas inlet 21 can be replaced by a gas inlet membrane hose as illustrated in FIGS. 4 and 5. The second gas inlet 22 is formed by bores in the inner pipe 32. The perforation of the inner pipe 32 is extended with a length of e.g. about 20 cm to 30 cm. The first and second gas inputs 21, 22 empty into a thorough mixing zone 23 in which the gaseous reaction partners are thoroughly mixed. The thorough mixing zone 23 can be formed by the intermediate space between the inner and outer pipes 32, 31 of the piping arrangement 30; however it is preferable that solid boundary surfaces such as, e.g., rods additionally project into this inner space by means of which the thorough mixing of the gaseous reaction partners is improved. The reaction zone 24, in which the catalyst 25 is arranged, is located above the thorough mixing zone 23. In the example shown the catalyst is a noble-metal catalyst like the one described by way of example in conjunction with the conventional laboratory experiments cited above. The axial length of the catalyst 25 is selected as a function of the concrete conditions of use, particularly of the expected substance throughput and of geometrical parameters such as, e.g., the diameter of the borehole. The axial length of the reaction zone 24 is e.g. 60 cm.

In FIG. 1, the catalyst 25 is shown as being distributed in the whole volume of the reaction zone 24. According to an alternative embodiment of the invention, the catalyst is arranged on the inner surface of the outer pipe 31. Accordingly, the thermal energy generated during the reaction in the reactor zone can be transmitted directly during the surrounding gas hydrate formation. Alternatively, the inner surface can be coated with platinum, palladium, rhodium or a barium hexaaluminate powder including one of the afore mentioned noble-metals.

Preferably, the wall surrounding the reaction zone, in particular the wall of outer pipe 31 is made of a heat-resistant material, like e.g. molybdenum or a heat-resistant steel (e.g. type Boehler N 700).

The reference numeral 40 refers in general to the schematically shown operating device with components for the known introduction of the bore into the earth's crust, for controlling the air supply, for initiating the start reaction for the catalyst and for process monitoring. If the storage, in accordance with the invention, of gaseous components or resultant products formed from them is provided in gas hydrate formation 10, the operating device 40 also contains a pressure device for introducing the substances to be stored under elevated pressure into gas hydrate formation 10.

The thermal stimulation of the gas hydrate formation according to the invention comprises the following process steps. At first, a boring into gas hydrate formation 10 takes place. Reactor 20, provided with a noble-metal catalyst 25 is introduced into this boring in such a manner that reaction zone 24 is located at a predetermined height above gas hydrate formation 10.

The ignition of reactor 20 takes place after the positioning of reactor 20. A temperature of approximately 450 to 500° C. at the catalyst 25 is normally required in order to start the reaction of the partial oxidation of methane to synthesis gas. These temperatures are achieved when a gaseous mixture consisting of approximately 5% hydrogen in air is fed into the cold reactor through the inner tube 32. This gaseous mixture ignites spontaneously at room temperature already on catalyst 25. The strongly exothermal combustion of hydrogen to water rapidly results in the heating of the catalyst 25 to the desired reaction temperature. As soon as this temperature has been achieved on the catalyst and the methane flows from the surrounding gas hydrates into the reactor, the supply of hydrogen is interrupted. The direct partial oxidation of methane to synthesis gas, which takes place autothermally, for the thermal stimulation of the gas hydrates and their decomposition follows.

The direct partial oxidation of methane to synthesis gas takes place on catalyst 25. The stoichiometry of this reaction route leads directly to the ratio of 2/1 for $H_2$/CO that is desired for typical subsequent processes (such as, e.g., the synthesis of methanol). The typical reaction temperatures (800 to 1200° C.) result in high conversion rates and short contact times. The high temperatures on the catalyst achieved during the reaction are removed as heat into the surrounding sediment 10 with gas hydrate in order to disturb the pressure-temperature equilibrium of the gas hydrates and bring about the decomposition of the gas hydrates. The inwardly radiated reaction heat advantageously conditions a preheating of the supplied oxidation agent (air/oxygen), which for its part favors the course of the reaction of the partial oxidation.

Since the methane gas from the gas hydrates is not only released, but also reacted and removed therewith, a reduction of pressure takes place in the close proximity of the reactor, which for its part accelerates the decomposition of the surrounding gas hydrates. The process is continued until the thermal transport through the sediment no longer suffices for disturbing the stable p-T-equilibrium of the gas hydrates and for bringing about their decomposition. The synthesis gas transported to the surface can be reacted there either to methanol or can be separated into carbon monoxide and hydrogen.

After completing the decomposition of gas hydrates in the formation surrounding the reactor, the piping arrangement can be shifted through the gas hydrate containing sediment layer up or down to another depth below the surface for further local decomposing hydrate and supplying methane.

Figure 2:
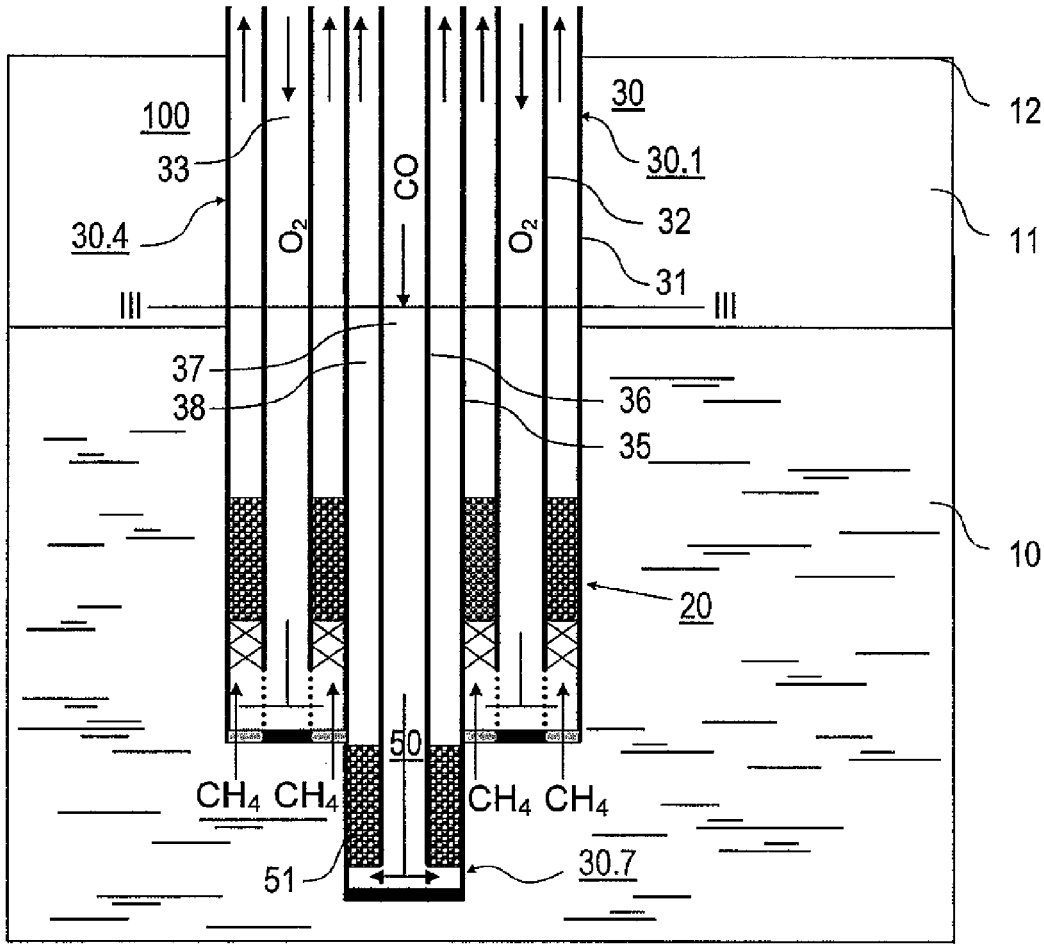
FIG. 2: shows a schematic longitudinal section of another embodiment of the invention with several tube reactors.
Figure 3:
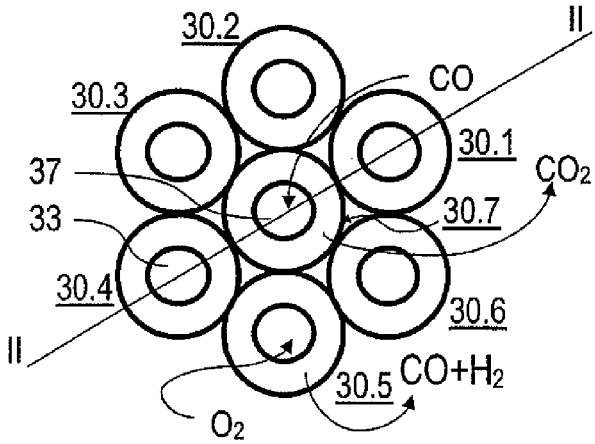
FIG. 3: shows a schematic cross sectional representation of the embodiment according to FIG. 2.

A more complex design of piping arrangement 30 is provided for the embodiment of device 100 in accordance with the invention shown in FIG. 2 for the thermal stimulation of gas hydrate formation 10. The piping arrangement 30 comprises, e.g., seven coaxial arrangements 30.1 to 30.7 that have a concentric design with an outer and an inner pipe 31, 32 and 35, 36 in analogy with the design described above but differ in their function and therefore also in details of the conduction of gas. The geometric arrangement of coaxial arrangements 30.1 to 30.7 is illustrated in FIG. 3 with the cross section of the piping arrangement 30 along line III-III in FIG. 2. FIG. 2 corresponds to the longitudinal section along line II-II in FIG. 3.

The coaxial arrangements 30.1 to 30.6 that are constructed like piping arrangement 30 according to FIG. 1 serve for the thermal stimulation of the gas hydrates in accordance with the process described above. Coaxial arrangement 30.7 is provided in the middle of piping arrangement 30 with two coaxially positioned pipes 35, 36 that form a central inlet line 37 for the return of one of the reaction products (carbon monoxide) to additional reactor 50 and form an outlet 38 in the form of a cylindrical jacket for the removal of the converted reaction product (carbon dioxide) to the surface. Additional reactor 50 is also a tube reactor that is arranged offset from reactor 20 with an axial interval at a greater depth in gas hydrate formation 10 and is provided for the oxidation of carbon monoxide to carbon dioxide on catalyst 51 (consisting, e.g., of platinum).

The thermal stimulation of gas hydrate formation 10 according to the invention takes place in analogy with the above-described reaction route, that is, methane is converted in the reactors 20 in accordance with the equation indicated in the lower part of FIG. 2. After a partial condensation and separation of the synthesis gas on the surface of the earth the carbon monoxide is returned through the inlet line 37 to the additional reactor 50, where the oxidation in accordance with the second equation in the lower part of FIG. 2 to carbon dioxide takes place.

When the thermal decomposition is ended in the vicinity of device 100, the storage of carbon dioxide in accordance with the invention can take place in the sediment layer that is now hydrate-free but contains water. After device 100 cools down, carbon dioxide is pressed through the inlet lines 33, 37 under elevated pressure to the end of the piping arrangement 30 and through the latter into the surrounding layer, where $CO_2$ hydrates form. Advantageously, the gas permeable gas inlet membrane hoses can be used for $CO_2$ transfer into the geological formation.

The embodiment according to FIGS. 2, 3 can be modified in such a manner that more or fewer coaxial arrangements are provided as a function of the concrete usage in the compound of piping arrangement 30, by which coaxial arrangements the functions of the conversion of hydrocarbons and of carbon monoxide are met.

As a further example, illustrated in FIG. 4, up to 12 reactors can be provided each of which comprising a coaxial arrangement as described above. FIG. 4 shows 12 reactors, wherein 3 inner reactors 30.*i* are surrounded by 9 outer reactors 30.*o*.

According to a preferred embodiment of the invention, the reactors are arranged with different depths below the surface, so that the zone heated with the exothermal reaction according to the invention is extended. As an example, the 3 inner reactors represent a lowest tip of the piping arrangement 30, while 4 of the outer reactors are displaced with a predetermined distance relative to the inner reactors and the remaining 5 outer reactors are further displaced. With a displacement of about 80 cm between the three groups of reactors, the whole length of the heated zone is about 240 cm.

For improving the efficiency of methane gas collection, the gas inlets (reference numeral 21 in FIG. 1) can be provided with or replaced by gas inlet hoses. FIG. 5 schematically illustrates the provision of gas inlet hoses 21.1, 21.2 at the lower ends of coaxial arrangements 30.1, 30.2. The gas inlet hoses 21.1, 21.2 are made of a membrane being permeable for gases. The inner volume of the gas inlet hoses 21.1, 21.2 is filled with silica gel having a mean particle sizes of about 0.5 mm to 1 mm. Advantageously, the silica gel is capable to fulfill two functions simultaneously. Firstly, the silica gel provides pressure stability to the gas inlet hoses against the surrounding pressure of the gas hydrate formation, which in the decomposed or partially decomposed state represents a slurry surrounding. Secondly, silica gel is able to reduce the content of water vapor in the gas flowing into the hose. The provision of a drying substance (silica gel) in the gas inlet hose minimizes a deteriorating effect of water vapor for the exothermal reaction in the reactor. Accordingly, the efficiency of heat production in the gas hydrate formation is improved.

The gas inlet hoses 21.1, 21.2 are connected to the lower end of the piping arrangement or a base plate 26 with a pipe adaptor or with a screwing connector. The hoses have an outer diameter of about 0.4 cm and a length of about 100 cm. With the above example of 12 reactors, the whole length with the membrane hoses comprises about 340 cm.

Figure 6:
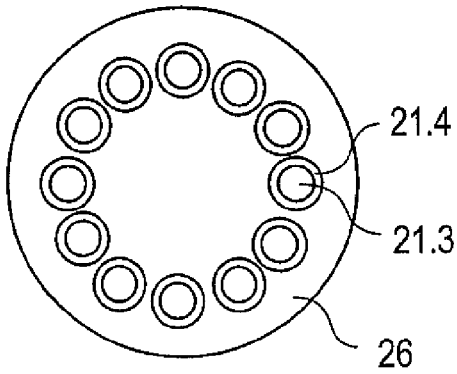
FIG. 6: shows a schematic cross sectional view of a further embodiment of the invention with gas inlet membrane hoses.

FIG. 6 illustrates a further example of a piping arrangement with 12 coaxial reactors. The cross sectional view of the lower part of the piping arrangement shows 12 gas inlet hoses 21.3, each of which being fixed with a connector 21.4 to the base plate 26 of the piping arrangement. With a bundle of 12 reactors and a permeability of the gas inlet hoses of about 300 l/min, more than $2.2 \cdot 10^5$ l synthesis gas could be produced per day.

The invention was described using the example of the partial oxidation of methane. It is emphasized that the implementation of the invention is not limited to this example but rather is possible in a corresponding manner with other hydrocarbons. Furthermore, other exothermal conversions of hydrocarbons, e.g., a complete oxidation of methane from the gas hydrate formation, can be provided.

The features of the invention disclosed in the above specification, in the claims and the drawings can be significant both individually as well as in combination with each other for realizing the invention in its various embodiments.

What is claimed is:

1. A device for the thermal stimulation of a geological gas hydrate formation, the device comprising:

a heating device for supplying thermal energy with which gas hydrates in the gas hydrate formation can be converted and gaseous components can be released, wherein the, heating device comprises a plurality of reactors for carrying out an exothermal chemical reaction in which a catalyst is arranged in the reactors, which reactors can be introduced into a bore into the gas hydrate formation; and multiple coaxial piping arrangements that can be introduced into the gas hydrate formation and that are each provided with at least one of said reactors, wherein the reactors are positioned along the piping arrangements with an axial distance relative to each other.

2. A device according to claim 1, in which the reactor comprises a tube reactor with a reaction zone that is arranged on the outer circumferential edge of the tube reactor.

3. A device according to claim 1, in which the catalyst contains a noble metal as catalytic material.

4. A device according to claim 3, in which the catalyst contains platinum, palladium or rhodium as catalytic material.

5. A device according to claim 1, in which the catalyst contains a metallic oxide or metallic hydroxide as catalytic carrier material.

6. A device according to claim 5, in which the catalyst contains aluminum oxide or barium hexaaluminate as catalytic carrier material.

7. A device according to claim 6, in which the catalytic carrier material comprises a foam monolith or an extruded monolith.

8. A device according to claim 5, in which the catalytic carrier material comprises a foam monolith or an extruded monolith.

9. A device according to claim 1, in which a pressure device is provided for introducing gaseous components or reactive products formed from them released during the thermal conversion of the gas hydrate formation into the gas hydrate formation.

10. A device according to claim 1, in which the reactors can be introduced with the piping arrangement into the gas hydrate formation.

11. A device according to claim 1, wherein the catalyst is arranged on an inner surface of an outer wall of the reactor.

12. A hydrate extraction system comprising at least one device in accordance with claim 1.

13. A method of using a hydrate extraction system in accordance with claim 12 for transporting gas from a subterranean or submarine gas hydrate formation or for the controlled extraction of the gases from a gas hydrate formation.

14. A method of using device in accordance with claim 1 for transporting gas from a subterranean or submarine gas hydrate formation or for the controlled extraction of the gases from a gas hydrate formation.

15. A device for the thermal stimulation of a geological gas hydrate formation, the device comprising:

a heating device for supplying thermal energy with which gas hydrates in the gas hydrate formation can be converted and gaseous components can be released, wherein the heating device comprises a plurality of reactors for carrying out an exothermal chemical reaction, which reactors can be introduced into a bore into the gas hydrate formation; and multiple coaxial piping arrangements that can be introduced into the gas hydrate formation and that are each provided with at least one of said reactors, wherein the reactors are positioned along the piping arrangements with an axial distance relative to each other;

in which the heating device has an additional reactor contained in the piping arrangement for carrying out an exothermal subsequent reaction.

16. A device according to claim 15, in which a catalyst is arranged in the additional reactor.

17. A device according to claim 15, in which at least one of several additional reactors is provided in the piping arrangement.

18. A device for the thermal stimulation of a geological gas hydrate formation, the device comprising:

a heating device for supplying thermal energy with which gas hydrates in the gas hydrate formation can be converted and gaseous components can be released, wherein the heating device comprises a plurality of reactors for carrying out an exothermal chemical reaction, which reactors can be introduced into a bore into the gas hydrate formation; and multiple coaxial piping arrangements that can be introduced into the gas hydrate formation and that are each provided with at least one of said reactors, wherein the reactors are positioned along the piping arrangements with an axial distance relative to each other;

in which the reactors are provided with at least one gas inlet membrane hose.

19. A device according to claim 18, wherein the gas inlet membrane hose includes a drying agent.

* * * * *

UNITED STATES PATENT AND TRADEMARK OFFICE

CERTIFICATE OF CORRECTION

PATENT NO. : 7,905,290 B2
APPLICATION NO. : 12/559894
DATED : March 15, 2011
INVENTOR(S) : Judith Maria Schicks It is certified that error appears in the above-identified patent and that said Letters Patent is hereby corrected as shown below:

Title Page, please insert:

-- Foreign Application Priority Data

Oct. 6, 2004 (DE)..... 10 2004 048 692.1 --

Signed and Sealed this
Twenty-sixth Day of April, 2011

David J. Kappos

David J. Kappos
*Director of the United States Patent and Trademark Office*